US006112052A

United States Patent [19]

Guthrie et al.

[11] Patent Number: 6,112,052

[45] **Date of Patent: *Aug. 29, 2000**

[54] REMOTE CONTROLLED NOISE JAMMING DEVICE

[75] Inventors: Warren E. Guthrie, Glen Ellyn; Robert Edward Rozak, Evanston, both of Ill.

[73] Assignee: Northrop Grumman Corporation, Los Angeles, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/790,915

[22] Filed: Jan. 29, 1997

[51] Int. Cl.[7] ..... H04K 3/00

[52] U.S. Cl. ..... 455/1; 455/69; 455/420

[58] Field of Search ..... 455/1, 38.2, 68, 455/69, 70, 92, 352, 151.1, 420, 86; 380/6; 340/825.69, 825.72; 342/14, 15

[56] References Cited

U.S. PATENT DOCUMENTS

| | | | |
|---|---|---|---|
| 3,142,060 | 7/1964 | Goldmark | 343/18 |
| 3,431,496 | 3/1969 | O'Donnell | 325/132 |
| 3,845,482 | 10/1974 | Jirousek et al. | 343/18 |
| 4,097,865 | 6/1978 | Jones | 343/18 |
| 4,121,214 | 10/1978 | Marinaccio et al. | 343/18 |
| 4,328,496 | 5/1982 | White | 343/18 |
| 4,334,322 | 6/1982 | Clark | 455/62 |
| 4,433,333 | 2/1984 | Manoogian et al. | 343/18 |
| 4,467,328 | 8/1984 | Hacker | 343/18 |
| 4,498,193 | 2/1985 | Richardson | 455/1 |
| 4,586,046 | 4/1986 | Pringle et al. | 343/18 |
| 4,596,988 | 6/1986 | Wanka | 455/92 |
| 4,719,649 | 1/1988 | Woodsum et al. | 455/2 |
| 4,876,545 | 10/1989 | Carlson et al. | 342/14 |
| 5,001,771 | 3/1991 | New | 455/1 |
| 5,233,652 | 8/1993 | Huang et al. | 380/7 |

*Primary Examiner*—Lee Nguyen

*Attorney, Agent, or Firm*—Terry J. Anderson; Karl J. Hoch, Jr.

[57] ABSTRACT

A remotely operable radio frequency jamming device having a jamming transmitter and a local controller in communication with a remote commander. The local controller has a signal receiver and decoder component for receiving, decoding and causing by electronic command the device to perform a remotely initiated instruction signal. In particular, the receiver and decoder component of the local controller can receive and decode a remotely initiated instruction signal to activate or inactivate the jamming device and thereafter cause by electronic command the activation or deactivation of the device. To effectuate the jamming of enemy radio signals, the receiver and decoder component of the local controller can receive and decode a remotely initiated instruction signal to transmit a selected jamming band from the transmitter of the jamming device, and thereafter cause by electronic command the transmitter to transmit the selected band. The jamming device preferably is operable on low power, and preferably is relatively small so that its presence can be relatively easily hidden.

5 Claims, 1 Drawing Sheet

REMOTE CONTROLLED NOISE JAMMING DEVICE

FIELD OF THE INVENTION

The present invention relates in general to radio frequency jamming devices, and in particular to a remote controlled noise jammer having a signal receiver and decoder component for receiving and performing a remotely initiated instruction signal command for activation and transmission of a selected jamming signal.

BACKGROUND OF THE INVENTION

There are many military operations where the employment of radio frequency jamming is beneficial in controlling enemy activities by interfering with communications between a headquarter location and a field location. For jamming to be effective, however, it many times is necessary for jamming devices to be present in enemy territory. If a jamming device requires constant physical tending by personnel, it is apparent that its use is severely limited in that safety considerations must be addressed and personnel deployment behind enemy lines may not occur.

Since manned jamming devices may not be a choice, a plurality of low power jamming devices can be placed at various sites and abandoned. When this occurs, the devices must be left in an activated state which means that they are dependent on self-contained batteries for power. Obviously, once battery power is expended, the jamming devices have no further utility. Additionally, during the time the devices are powered, an enemy can locate the devices electronically and destroy or otherwise inactivate their radio jamming transmissions.

In view of the above considerations, it is apparent that a need is present for a jamming device that not only can be remotely placed, but also that can continue to function over a relatively significant period of time without being easily discoverable. It is therefore a primary object of the present invention to provide a jamming device whose activation and deactivation can be controlled remotely.

Another object of the present invention is to provide such a jamming device having a receiver and decoder whereby a coded instruction signal can be received, decoded, and heeded.

Yet another object of the invention is to provide such a jamming device of relatively small size to thereby enhance difficulty for an enemy in locating the device.

These and other objects of the present invention will become apparent throughout the description thereof which now follows.

SUMMARY OF THE INVENTION

The present invention is a remotely operable radio frequency jamming device comprising a jamming transmitter and local controller in communication with a remote commander. The local controller has a signal receiver and decoder component for receiving, decoding and causing by electronic command the device to perform a remotely initiated instruction signal. In particular, the receiver and decoder component of the local controller can receive and decode a remotely initiated instruction signal to activate or inactivate the jamming transmitter and thereafter cause by electronic command the activation or deactivation of the device. To effectuate the jamming of enemy radio signals, the receiver and decoder component of the local controller can receive and decode a remotely initiated instruction signal to transmit a selected jamming band from the jamming transmitter of the jamming device, and thereafter cause by electronic command the transmitter to transmit the selected band. The jamming device preferably is operable on low power, generally ranging from between about 0.1 watt and about 10 watts. Receiving range and transmitting range is preferably from about 0.1 km to about 10 km. Size of each jamming device is preferably relatively small so that its presence can be more easily hidden in terrain or other untoward environments as typically could be found in enemy territories.

As is apparent from the above description, an operator of a remote command transmitter preferably located in a friendly territory can send various instruction signals to the present remotely-situated jamming device. Particularly important is the fact that activation and deactivation of the jamming transmitter can be performed remotely to thereby increase operational life by conserving battery power as well as interfere with an enemy's locating and destroying the device because the jamming signal is not constant. Additionally, because the device can receive and decode instruction signals regarding particular jamming signals to be transmitted and thereafter cause the transmitter thereof to transmit the chosen jamming signal, such jamming signals can be changed from a remote location as often as necessary to thereby obstruct circumvention of the transmitted jamming signal by the enemy. Finally, because the instruction signal sent to the device is coded, learning the content of the instruction on the part of the enemy is inhibited. Therefore, in this manner, a user of the present invention is able to effectively disrupt enemy communication links.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
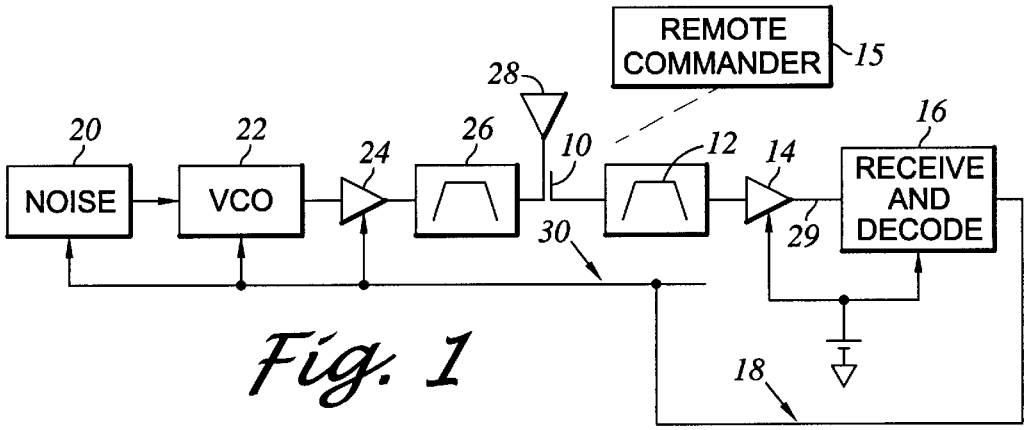
FIG. 1 is a block diagram of circuitry for a noise jamming device.

The present invention is a remotely-controlled noise jamming device that can be situated at a distant site to effectuate jamming of radio signals transmitted by an enemy source. As illustrated in FIG. 1, the jamming device has a conventional receiving antenna 28 that receives an instruction signal 10 such as a command from a remote commander 15 to activate or deactivate the device, or a command to transmit a selected jamming signal. The signal is decoded by an appropriate radio frequency receiver 16. Demodulated data 29 is presented to a local controller 16 having a decoder component that functions to identify the remotely-initiated instruction signal. In the embodiment here described, the controller 16 is manufactured by Microchip Technologies, Catalog No. PIC16C74. If the signal relates to activation of the device, the receiver and decoder component of the local controller 16 actuates the controller to electronically relay the appropriate command 18 to control the noise generator 20 and voltage controlled oscillator (VCO) 22. If the instruction signal is to select the jamming band as is illustrated in FIG. 1, the signal likewise passes through the amplifier 14 to the controller 16 where the instruction signal is received and decoded. Thereafter, the proper jamming band is conveyed by the local controller bus 30 to a noise generator 20 and the VCO 22 which operates approximately the desired output frequency range while energizing an amplifier 24. Random noise from the noise generator 20 is applied to the VCO 22 with appropriate average DC voltage as required to set the jamming signal. Next, the signal passes through the amplifier 24 to a band selecting filter 26 for subsequent jamming transmission through the antenna 28 to thereby interfere with enemy radio transmission. In an alternate embodiment, the noise generator 20 can be in direct communication with the amplifier 24, with the noise generator 20 there operating at approximately the desired output frequency range. A preferred power source is a three to six volt lithium cell battery generally having an expected life of about 10 to about 100 hours based on continuous transmission. Size and configuration of an entire device is preferably from about 20 to about 30 cubic inches in a flattened cylindrical shape which is similar to a hockey puck.

Figure 2:
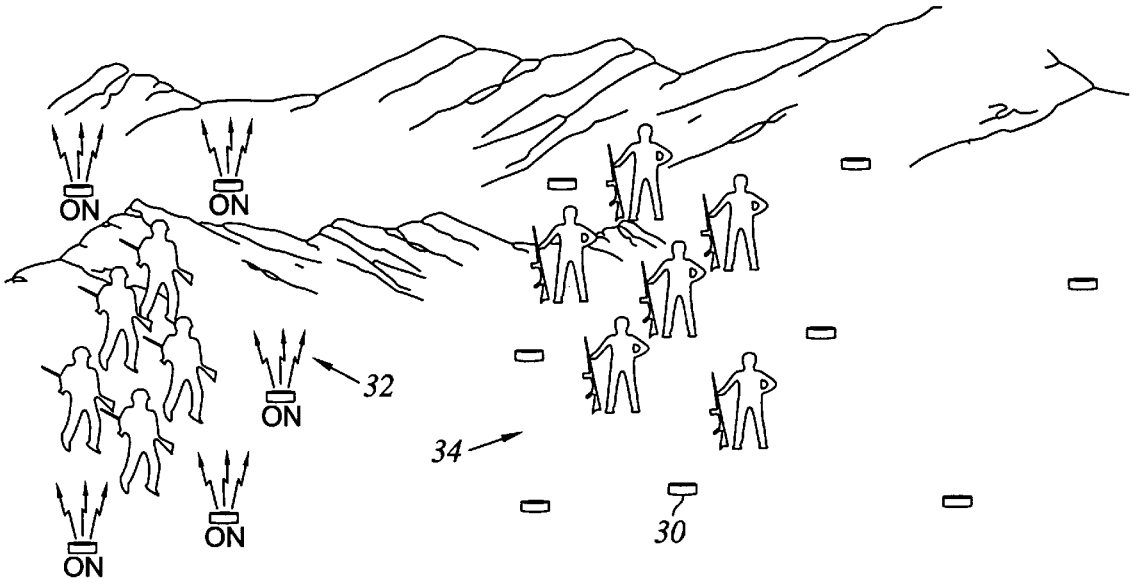
FIG. 2 is an illustrative example, not to scale, of deployment of a plurality of noise jamming devices.

Deployment of a plurality of jamming devices of the present invention effectively interferes with enemy communications and confuses the enemy because of the remote control capabilities of the present jamming device. Thus, as illustrated in FIG. 2, except for not being to scale, a number of jamming devices 30 can be situated within a geographical expanse, with each such device 30 individually operable from a remote location. Because of the individuality of activation, one group 32 of devices can be activated ("on"), while another group 34 can be non-activated. Once again, and because of the remote-instruction functionality of the device 30, rapid and selective activation and deactivation of each device 30 coupled with selective changes in jamming band characteristics can cause significant confusion and resultant ineffectiveness in enemy actions and reactions.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A remotely operable radio frequency jamming system comprising:

a) a remote commander for sending selectable instructional command signals; and b) a concealably placeable jamming device comprising:

i) a jamming transmitter;

ii) a local controller in communication with the commander, said controller having a signal receiver and decoder component for receiving and decoding said selectable instructional command signals from the commander, said command signals comprising activation of the jamming transmitter, deactivation of the jamming transmitter, and transmission of a jamming signal of a selected frequency to the jamming transmitter; and iii) delivery circuitry for relaying from said controller to said jamming transmitter said selectable instructional commands according to said command signals after decoding thereof by said controller.

2. A remotely operable radio frequency jamming system as claimed in claim 1 wherein power transmitted by the jamming transmitter is about 0.1 watt to about 10 watts.

3. A remotely operable radio frequency jamming system as claimed in claim 1 wherein size of the jamming device is from about 15 to about 25 cubic inches.

4. A remotely operable radio frequency jamming system as claimed in claim 1 wherein the receiver and decoder component of the controller can receive and decode selectable instructional command signals over a distance of from about 0.1 km to about 10 km.

5. A remotely operable radio frequency jamming system as claimed in claim 1 wherein the selected frequency of the jamming signal is a selected jamming band.

* * * * *